US008094101B2

(12) United States Patent
Le Roy et al.

(10) Patent No.: US 8,094,101 B2
(45) Date of Patent: Jan. 10, 2012

(54) DISPLAY PANEL AND CONTROL METHOD USING TRANSIENT CAPACITIVE COUPLING

(75) Inventors: Philippe Le Roy, Betton (FR); Arnaud Trochet, Rennes (FR); Sylvain Thiebaud, Noyal sur Vilaine (FR)

(73) Assignee: Thomson Licensing, Boulogne-Billancourt (FR)

( * ) Notice: Subject to any disclaimer, the term of this patent is extended or adjusted under 35 U.S.C. 154(b) by 322 days.

(21) Appl. No.: 12/086,874

(22) PCT Filed: Dec. 19, 2006

(86) PCT No.: PCT/EP2006/069925

§ 371 (c)(1),
(2), (4) Date: Sep. 23, 2009

(87) PCT Pub. No.: WO2007/071681

PCT Pub. Date: Jun. 28, 2007

(65) Prior Publication Data

US 2010/0020056 A1 Jan. 28, 2010

(30) Foreign Application Priority Data

Dec. 20, 2005 (FR) ..... 05 53979

(51) Int. Cl.
*G09G 3/32* (2006.01)

(52) U.S. Cl. ..... 345/82

(58) Field of Classification Search ..... 345/204–209, 345/82–84

See application file for complete search history.

(56) References Cited

U.S. PATENT DOCUMENTS

| | | | | |
|---|---|---|---|---|
| 4,649,383 | A * | 3/1987 | Takeda et al. | 345/92 |
| 6,229,506 | B1 | 5/2001 | Dawson et al. | |
| 6,618,030 | B2 | 9/2003 | Kane et al. | |
| 6,777,888 | B2 | 8/2004 | Kondo | |
| 6,885,029 | B2 | 4/2005 | Miyazawa | |
| 7,580,015 | B2 * | 8/2009 | Tai et al. | 345/82 |
| 2001/0024186 | A1 | 9/2001 | Kane et al. | |
| 2003/0052614 | A1 | 3/2003 | Howard | |
| 2003/0112205 | A1 | 6/2003 | Yamada | |
| 2005/0052366 | A1 | 3/2005 | Kim | |
| 2006/0253755 | A1 * | 11/2006 | Wu | 714/726 |
| 2007/0091029 | A1 * | 4/2007 | Uchino et al. | 345/76 |
| 2009/0009504 | A1 * | 1/2009 | Thiebaud et al. | 345/212 |
| 2009/0015575 | A1 * | 1/2009 | Le Roy et al. | 345/209 |

FOREIGN PATENT DOCUMENTS

| | | |
|---|---|---|
| EP | 1094438 | 4/2001 |
| EP | 1197943 | 4/2002 |
| WO | WO 2005055184 A1 * | 6/2005 |
| WO | WO2005071648 | 8/2005 |
| WO | WO2005073948 | 8/2005 |

OTHER PUBLICATIONS

Search Report dated Feb. 12, 2007.

* cited by examiner

*Primary Examiner* — Amr Awad
*Assistant Examiner* — Liliana Cerullo
(74) *Attorney, Agent, or Firm* — Robert D. Shedd; Jeffrey M. Navon

(57) ABSTRACT

Panel comprising display drivers which, each 1''', comprise a select switch and a clamping switch which are controlled by the same select electrode, and a coupling capacitor for transiently coupling the control terminal of this circuit C to an address electrode. A control method comprising emission periods and depolarization periods, where all the address signals have the same polarity. The invention makes it possible in particular to use conventional and inexpensive means of controlling the address electrodes.

8 Claims, 2 Drawing Sheets

DISPLAY PANEL AND CONTROL METHOD USING TRANSIENT CAPACITIVE COUPLING

Figure 1:
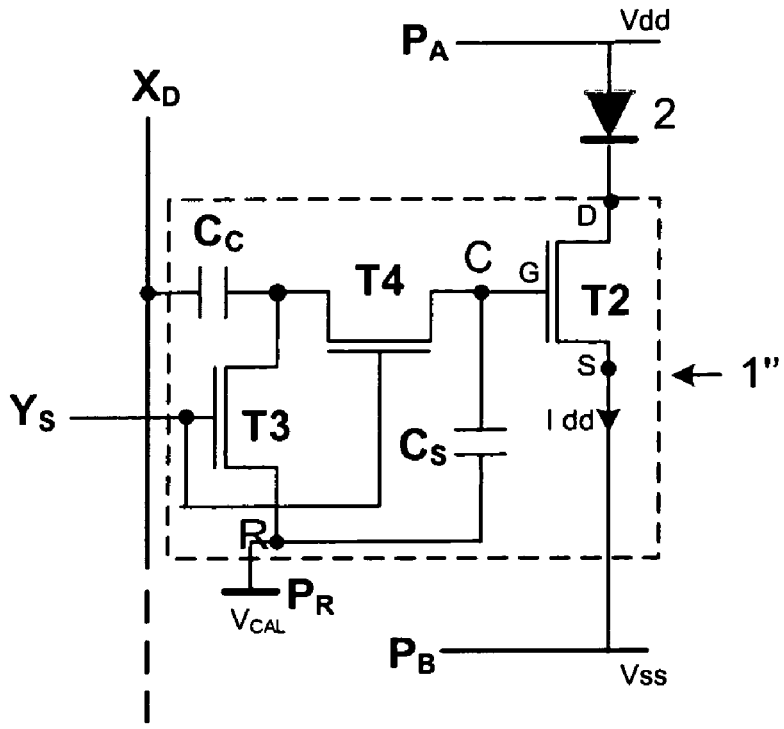

This application claims the benefit, under 35 U.S.C. §365 of International Application PCT/EP2006/069925 filed Dec. 19, 2006, which was published in accordance with PCT Article 21(2) on Jun. 28, 2007 in French and which claims the benefit of French patent application No. 0553979, filed Dec. 20, 2005.

The invention relates to active matrix panels that can be used to display images using arrays of light emitters, for example of light-emitting diodes, or arrays of optical valves, for example liquid crystal valves. These emitters or these valves are normally divided up into rows and columns.

The term "active matrix" denotes a substrate which integrates arrays of electrodes and circuits suitable for controlling and supplying power to the emitters or optical valves supported by this substrate. These arrays of electrodes normally comprise at least one array of address electrodes, one array of select electrodes, at least one reference electrode for addressing and at least one base electrode for supplying power to these emitters. Sometimes, the reference electrode for addressing and the base electrode for the power supply are combined. The panel also comprises at least one upper power supply electrode, normally common to all the valves or to all the emitters, but which is not integrated in the active matrix. Each valve or emitter is normally inserted between a base power supply terminal linked to a base electrode for the power supply and the upper power supply electrode which normally covers all the panel.

Each control circuit (or "driver") comprises a control terminal linked or coupled to an address electrode via a select switch, a select terminal which corresponds to the control of this switch and which is linked to a select electrode, and a reference terminal linked or coupled to a reference electrode.

Each driver therefore comprises a select switch suitable for transmitting to this circuit the address signals originating from an address electrode. The closure of the select switch of a circuit corresponds to the selection of that circuit.

Generally, each address electrode is linked or coupled to the control terminals of the drivers of all the emitters or of all the valves of one and the same column; each select electrode is linked to the select terminals of the drivers of all the emitters or of all the valves of one and the same row. The active matrix can also comprise other row or column electrodes.

The address electrodes are used to address to the drivers control signals, voltage- or current-mode analogue, or digital; during the emission periods, each control signal intended for the driver of a valve or of an emitter is representative of an image datum of a pixel or sub-pixel associated with that valve or that emitter.

In the case of a panel of optical valves, each driver and power supply circuit comprises a memory element, normally a capacitor designed to sustain the control voltage of that valve for the duration of an image frame; this capacitor is connected in parallel directly to this valve. The control voltage of a valve is the potential difference at the terminals of that valve. In a particularly simple driver case, the control terminal of the circuit is linked or coupled to one of the terminals of the valve.

In the case of a panel of current-controllable emitters, for example of light-emitting diodes, in particular of organic diodes, each driver and power supply circuit normally comprises a current modulator, normally a TFT transistor, provided with two current-passing terminals, one source terminal and one drain terminal, and a gate terminal for voltage-mode control; this modulator is then connected in series with the emitter to be controlled, this series being in turn connected between an (upper) power supply electrode and a base electrode for the power supply; normally, it is the drain terminal which is common to the modulator and to the emitter, and the source terminal, linked to the base electrode for the power supply, is thus at a constant potential; the control voltage of the modulator is the potential difference between the gate and the source of the modulator; each driver comprises means for generating a control voltage of the modulator according to the signal addressed to the control terminal of that circuit; each driver also comprises, as previously, a sustain capacitor designed to sustain the control voltage of the modulator for the duration of each image or image frame. In a particularly simple driver case, the control terminal of the circuit corresponds to the gate terminal of the modulator. Conventionally, there are two types of control: voltage-mode control or current-mode control. In the case of a voltage-mode control, the address signals are voltage steps; in the case of current-mode control, the address signals are current steps.

In the case of current-mode control of emitter panels, each driver is designed in a way known per se to "program", based on a current signal, a control voltage of the modulator of this circuit, which is therefore applied to the gate terminal.

The address electrodes and the select electrodes are in turn controlled by control means ("electrode drivers") placed at the ends of these electrodes, at the edge of the panel; these means normally comprise controllable switches.

To ensure a good display quality of the images and/or to improve the life of the panel, it is important to regularly reverse the control voltage of the modulators of the drivers, and/or the power supply voltage of the valves or the emitters:

- in the case of panels of optical valves, in particular of liquid crystals, the voltage is normally alternated at the terminals of the valves to avoid initiating a direct liquid crystal polarization component;
- in the case of panels of light emitters, where the emitters are light-emitting diodes, it may be advantageous to regularly reverse the voltage at the terminals of the emitters, as described, for example, in documents EP1094438 and EP1197943; however, during the periods when this power supply voltage is reversed, these emitters obviously emit no light, the diodes then being polarized in the reverse direction;
- in the case of panels of current-controllable emitters, the drivers of which comprise a current modulator, where these modulators are transistors comprising active layers of amorphous silicon, it may be advantageous to regularly reverse the control voltage of the modulators, in particular to compensate for the trigger threshold voltage drifts of this type of transistor: documents US2003/052614, WO2005/071648 illustrate such a situation. When images are displayed, there are then distinguished, for each driver, display or emission periods, where the sign of this voltage is adapted to render the modulator passing, and so-called depolarization periods, when the sign of this voltage is reversed and does not allow the modulator to be rendered passing. For the overall control of the panel, the emission periods and the depolarization periods can overlap: while the emitters or valves of certain rows emit light, the circuits, emitters or valves of other rows can be being depolarized.

Nevertheless, overall, the alternation of these periods is prejudicial to the maximum luminance of the panel, since the overall time available for emission from the emitters is reduced by the duration of the depolarization periods. Still in the case of panels of current-controllable emitters, in order to avoid this reduction in luminance, document WO2005/073948 proposes a panel in which each emitter is provided with two drivers and is controlled alternately by one and by the other, and which entails duplicating the array of address electrodes. Other solutions, conversely, entail adding an array of row electrodes.

Document US2003/112205 describes a specific solution: by controlling the driver described in FIG. 6 as indicated in paragraphs 44 and 45 of this document, where a negative voltage Vee is applied to the reference address electrode (which is also the base electrode for the power supply), during the so-called "non-luminescence" periods, there is then obtained a reverse polarization at the terminals of the emitter (in this case, a light-emitting diode), and, during this reverse polarization, the control of the current modulator Tr2 which is in series with this emitter is cancelled (source and gate of this modulator are at the same potential because of the closure of the switch short-circuiting the sustain capacitor).

By using the solutions described in the documents US2003/052614, WO2005/071648, the means of controlling the address electrodes need to be adapted to transmit address signals of opposite signs or polarity; the solution described in document US2003/052614 entails adding a "toggle" element at the head of each address electrode; this adaptation condition entails a significant cost overhead in column "drivers".

One object of the invention is to avoid this drawback.

In the prior art, the address signals are normally transmitted to the drivers by direct conduction between the address electrodes and the control terminals of the circuits, via the select switch: in the case of the analogue voltage-mode control of panels of emitters, where the control terminal of the circuit corresponds to the gate terminal of the modulator, this gate voltage of the modulator is then equal to the voltage of the address electrode that controls this circuit, at least while this circuit is selected.

Document U.S. Pat. No. 6,229,506 describes the case where these address signals are, on the contrary, transmitted to the drivers by capacitive coupling: in the case of the voltage-mode control (FIGS. 3 and 4 in this document), a coupling capacitance (respectively referenced 350 and 450) here provides the link without direct conduction between the address electrode and the control terminal of the circuit. When such a circuit is selected, this arrangement makes it possible to add the voltage jump signal originating from the address electrode to a modulator trigger threshold voltage, previously stored in the circuit. The link by capacitive coupling, and not by conduction, between the address electrodes and the control terminals of the circuits in this case makes it possible to compensate the trigger threshold differences of the modulators of these circuits, so as to obtain a more uniform luminance of the screen and a better image display quality. To the same end, the other documents U.S. Pat. No. 6,777,888, U.S. Pat. No. 6,618,030, U.S. Pat. No. 6,885,029 describe a capacitive coupling between the address electrodes and the control of the current modulators of the emitters.

An essential aspect of the invention consists in using such a capacitive coupling for another purpose, namely in order to reverse the voltages at the valve terminals or at the emitter terminals, or the control voltages of the modulators of the drivers of these emitters, without having to reverse the address signals, which avoids the need for costly address electrode control means.

Thus, according to the invention, the voltage signal that is transmitted by capacitive coupling is, in particular, an address signal for the emission, which is representative of an image datum and/or an address signal (of the same sign) for the depolarization, in particular for the depolarization of the current modulator of an emitter.

As a general rule, capacitive coupling makes it possible to modify the voltage of a terminal by a voltage jump. Thus, a voltage step signal of algebraic value $\Delta V$ transmitted via capacitive coupling by an address electrode to a control terminal previously at the potential $V_{cal}$, changes the potential of that terminal from V to $V_{cal}+\Delta V$. This voltage jump is independent of the value $V_{ini}$ of the initial potential (before the jump) of the address electrode.

When the desire is for the potential of the control terminal of a circuit to reduce by a value $\Delta V$ ($\Delta V<0$) from an initial value $V_{cal}$ to the point of achieving a potential $V_{cal}+\Delta V$ of reverse sign of that that is applied to obtain the emission from the emitter controlled by this circuit, through the capacitive coupling, it is enough, according to the invention, for the initial value $V_{ini}$ (eg: $V_{ini}>0$) of the potential of the address electrode coupled to this terminal to be high enough for the algebraic sum $V_{ini}+\Delta V$ ($\Delta V<0$) to keep the same sign as $V_{ini}$, and therefore to choose $|V_{ini}|>|\Delta V|$.

For the control of the panel according to the invention as described in detail below, the control of each driver of an emitter comprises, when displaying each image frame, two periods, a period of emission from this emitter and a period of depolarization of the modulator of the driver of this emitter.

For the control of the panel according to the invention as described below in detail, in each control period of a circuit, at least of depolarization, if not also of emission:

1/this circuit is selected by capacitively coupling the control terminal of this circuit to an address electrode and the potential of this terminal is "clamped" to the potential $V_{cal}$ of a reference terminal of this circuit, which therefore becomes a clamping terminal; during this selection and this "clamping", a potential $V_{ini}$ is applied to the address electrode, with no effect other than transient, because of this clamping, on the potential of the control terminal which remains at the value $V_{cal}$;

2/with the circuit still being selected and the control terminal this time being still clamped to the clamping terminal, there is applied to the address electrode a voltage jump signal $\Delta V$ which is passed on by the capacitive coupling to the control terminal, according to the invention only transiently because of the sustaining of the clamping; the transient voltage peak is then "locked", by eliminating, at the instant of the peak, simultaneously, the coupling and the clamping of the step 1; the control terminal of the circuit thus changes from the potential $V_{cal}$ to the potential $V_{prog}=V_{cal}+\Delta'V$, and is sustained at this last potential through the locking operation.

During the rest of the current period (of emission or depolarization), the potential of the control terminal is sustained at this value by the sustain capacitor, as in the prior art.

It can therefore be seen that the value of $V_{ini}$ has no impact on the potential of the control terminal. According to the invention, in the voltage reversal or depolarization periods, the value of $V_{ini}$ is therefore adapted as in the first method so that $|V_{ini}|\geqq|\Delta V|$ in order for the potential to be applied to the address electrode to obtain $V_{prog}$ on the control terminal not to change sign. Thus, advantageously, the need for costly address electrode control means is avoided.

The same principle can be applied in order to reverse the voltages at the valve terminals or at the emitter terminals, without having to reverse the polarity between the power supply electrodes.

The method of controlling the panel according to the invention can be used either only during the depolarization periods (a conventional addressing by conduction is then used during the emission periods), or during both the emission and the depolarization periods.

An advantage of this control method is that it makes it possible to address to each circuit a specific depolarization signal, and to adapt the depolarization operation at the level of polarization of the modulator of each circuit, a level that depends in particular on the emission signal addressed in the preceding emission period.

Another advantage of the invention is that, since the select and clamping operations are always simultaneous, the same electrode can control the select switch and the clamping switch of the circuit; thus, advantageously, the number of electrodes in the active matrix is reduced compared to the first embodiment. This second method does, however, necessitate a very accurate adjustment of the locking compared to the application of the voltage jump ΔV.

The subject of the invention is therefore a display panel comprising:

an array of light emitters or optical valves, an active matrix comprising an array of electrodes for addressing voltage-mode signals, a first array of select electrodes, at least one reference electrode for addressing, an array of circuits each suitable for controlling each of said emitters or valves and each provided with a voltage-mode control terminal suitable for coupling to an address electrode via a coupling capacitor and a first select switch which are mounted in series, a voltage-mode clamping terminal suitable for connecting to said control terminal via a clamping switch, and a sustain capacitor mounted between said control terminal and said clamping terminal, where:

the clamping terminal is linked to the at least one reference electrode, the control of said first select switch and the control of said clamping switch are linked to the same select electrode of said first array.

Preferably, the clamping switch is of the same polarity as the select switch, such that a signal sent to the common control of these two switches induces the same closed or open state of these switches. Preferably, this common control is directly connected to a select electrode.

The emitters or valves are suitable to be powered between at least two power supply electrodes, namely a base electrode for the power supply that is normally part of the active matrix, and a so-called "upper" power supply electrode, which normally covers all the emitters or valves.

The sustain capacitor is suitable to sustain an approximately constant voltage on said control terminal for the duration of an image when said first select switch and said clamping switch are open.

Preferably, the panel comprises an array of light emitters suitable to be powered between at least one base power supply electrode and at least one upper power supply electrode, where each of said drivers of an emitter comprises a current modulator in turn comprising a voltage-mode control electrode forming the control electrode of said circuit and two current-passing electrodes that are connected between one of said power supply electrodes and a power supply electrode of said emitter. Normally, such a modulator is a TFT transistor; the current delivered by the modulator is then dependent on the potential difference between the gate terminal and the source terminal of this transistor; this potential difference is normally a function of, if not equal to, the potential difference between the control terminal and a reference electrode for the control voltage of the circuit; the reference electrode for the control voltage of the circuit is then formed by the base power supply electrode. Preferably, said current modulator is a transistor comprising a semiconductor layer of amorphous silicon.

Preferably, said emitters are light-emitting diodes, preferably organic.

Preferably, said driver comprises a second select switch linking said control terminal to said address electrode without passing through said coupling capacitor.

There are then, advantageously, two means of selecting the circuit:

either by capacitive coupling when the first select switch is used;

or by conduction when the second select switch is used.

Preferably, said active matrix then comprises a second array of select electrodes for the control of said second select switches.

Another subject of the invention is a method of controlling a panel according to the invention, which comprises a succession of periods during which a predetermined voltage $V_{prog\text{-}data}$, $V_{prog\text{-}pol}$ is applied and sustained at the control terminal of at least one driver of said panel, in which, in at least one period, said predetermined voltage $V_{prog\text{-}data}$, $V_{prog\text{-}pol}$ is applied to the control terminal of each circuit by transient capacitive coupling according to the following steps:

a clamping step, during which, said reference electrode of the panel being raised to a clamping potential, a select signal is applied to the select electrode that controls the first select switch and the clamping switch of said driver, this signal being suitable for closing said switches, and, while said select signal is being applied, an initial voltage signal $V_{ini\text{-}E}$, $V_{ini\text{-}P}$ is applied to the address electrode, a circuit programming step, during which, still while said select signal is being applied, after the clamping of the potential of the control terminal to the clamping potential $V_{cal}$ of the clamping terminal linked to said reference electrode has been obtained, and after the application of said initial signal, a final voltage signal $V_{data}$, $V_{pol}$ is applied to said address electrode, this final signal generating a voltage jump $\Delta V_{data}=V_{data}-V_{ini\text{-}E}$, $\Delta V_{pol}=V_{pol}-V_{ini\text{-}P}$ on this address electrode which in turn generates a transient voltage jump on the control terminal that is coupled to said address electrode, and, during said transient voltage jump, said select signal is ended, the values of said initial signal $V_{ini\text{-}E}$, $V_{ini\text{-}P}$ and of said final signal $V_{data}$, $V_{pol}$ being adapted to obtain at the moment when said select signal is ended, a voltage jump $\Delta V_{prog\text{-}data}=V_{prog\text{-}data}-V_{cal}$, $\Delta V_{prog\text{-}pol}=V_{prog\text{-}pol}-V_{cal}$ on said control terminal which makes it possible to obtain said predetermined voltage $V_{prog\text{-}data}$, $V_{prog\text{-}pol}$.

In practice, during the emission or depolarization periods, a predetermined emission or depolarization voltage is normally applied and sustained at the control terminal of each of said drivers of said panel.

The panel is normally intended to display a succession (or sequence) of images; each emitter or valve of the panel then has a corresponding pixel or sub-pixel of the images to be displayed; in some so-called emission periods, each emitter or valve of the panel has associated with it a predetermined emission voltage to be applied to the control terminal of the circuit which controls that emitter or valve, this voltage being adapted to obtain the display of said pixel or sub-pixel by this emitter or valve; according to a variant, between any two emission periods, there is inserted a depolarization period of the emitter, of the valve, and/or of the driver; in each depolarization period, each emitter or valve of the panel has associated with it a predetermined depolarization voltage, this voltage being adapted to depolarize said emitter, said valve and/or said circuit.

Thus, the predetermined voltage to be applied and sustained at the control terminal of the drivers of said panel is intended:

for the emitter or the valve of the panel that is controlled by this circuit to emit a pixel or a sub-pixel of the image to be displayed, and/or for the emitter or the valve of the panel, or the driver, or, where appropriate, the current modulator of this circuit, to be depolarized, at least partially.

The end of the select signal simultaneously opens the first select switch and the clamping switch of the driver. At this instant, the voltage of the control terminal is therefore equal to said predetermined voltage, and is maintained approximately at this value throughout the rest of the duration of the period thanks to the sustain capacitor to which this terminal is connected.

The transient voltage jump obtained at the control terminal is transient in the sense that, in the absence of interruption by the end of the select signal, the voltage at the control terminal would return to the clamping potential.

The duly obtained said predetermined voltage at the control terminal results from a voltage jump provoked at this terminal by transient capacitive coupling to the address electrode which is itself subject to a voltage jump; from this predetermined voltage, it is possible to deduce the voltage jump to be obtained at the control terminal by difference with the potential of the reference electrode to which this terminal has previously been clamped; from this voltage jump to be obtained at the control terminal, it is possible to deduce the voltage jump to be generated at the address electrode, according in particular, to the level of coupling with the control terminal and according to the time interval T between this voltage jump and the end of the select signal.

Preferably, the time interval T between said voltage jump at the address electrode and the end of said select signal is adapted so that the voltage jump obtained at the control terminal to be approximately maximum. Thus, the coupling between this control terminal and the address electrode is optimized. Preferably, if $C_C$ and $C_S$ denote the values of the capacitances respectively of the coupling capacitors and of the sustain capacitors, if R4 denotes the electrical resistance of the select switch when it is closed, if R3 denotes the electrical resistance of the clamping switch when it is closed, . . . if $T_0$ is defined by the equation:

$$T_0 = \frac{(R3 \times C_C) \cdot (R4 \times C_S)}{(R3 \times C_C) - (R4 \times C_S)} \mathrm{Ln}\left(\frac{R3 \times C_C}{R4 \times C_S}\right),$$

then, the time interval T between said voltage jump at the address electrode and the end of said select signal is such that $T_0 \leqq T \leqq 1.1\ T_0$.

Preferably, said periods comprise emission periods and depolarization periods; furthermore, the predetermined so-called depolarization voltage $V_{prog\text{-}pol}$ to be applied and to be sustained at the control terminal of a driver during a depolarization period is of polarity opposite to the predetermined so-called emission voltage $V_{prog\text{-}data}$ to be applied and to be sustained at the control terminal of the same circuit during an emission period, this emission voltage being obtained by the application of so-called emission signals to the address electrode to which said control terminal is suitable for coupling; furthermore, the at least one period of application of voltage by transient capacitive coupling comprises said depolarization periods and, for each of said depolarization periods and for the application by transient capacitive coupling of a predetermined depolarization voltage $V_{prog\text{-}pol}$ to the control terminal of each driver of said panel, said initial voltage signal $V_{ini\text{-}P}$ and said final voltage signal $V_{pol}$ are chosen such that they present the same polarity as said emission signals.

In practice, the difference $\Delta V_{pol}=V_{pol}-V_{ini\text{-}P}$ is first chosen to obtain the predetermined depolarization voltage $V_{prog\text{-}pol}$, in a manner known per se, to compensate for the polarization, for example the drift of the trigger threshold voltage of a current modulator that has occurred during a preceding emission period; then a sufficiently high value of $V_{ini\text{-}P}$ is chosen, of the same polarity as that of the emission signals, for the value of $V_{pol\text{-}1}$, devolving from said difference $\Delta V_{pol}$, to be of the same polarity as $V_{ini\text{-}P}$ and the emission signals.

Preferably, when the value of $\Delta V_{pol}$ permits it, $V_{ini\text{-}P}=0$ is chosen.

The polarity of the signals is evaluated relative to a reference electrode for the control voltage of the circuits; it can be, in particular, a base electrode for power supply to the emitters or the valves.

Thus, the voltage of the address electrode never changes sign and advantageously conventional and inexpensive means can be used for controlling the address electrodes.

Figure 2:
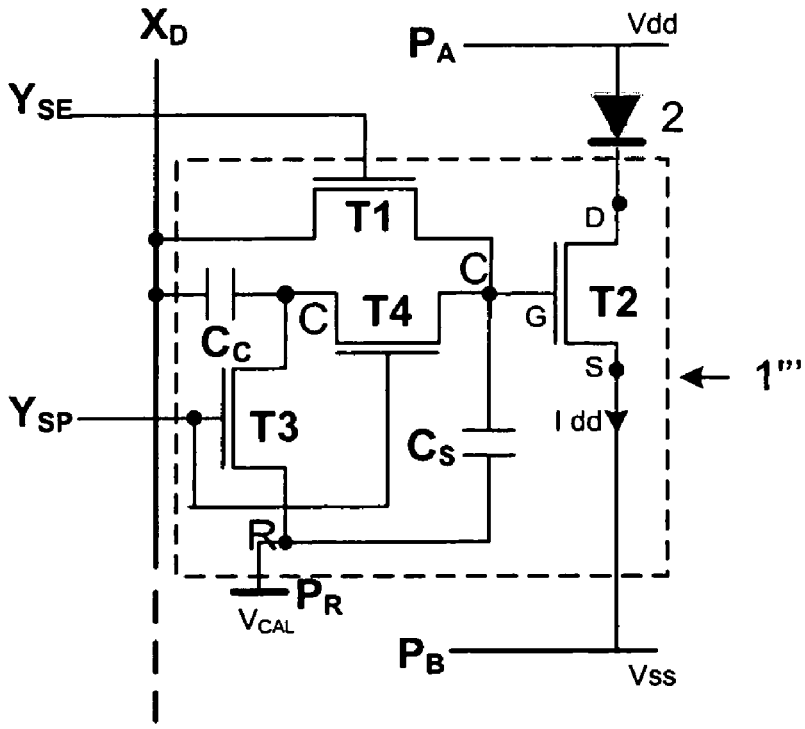
Figure 3:
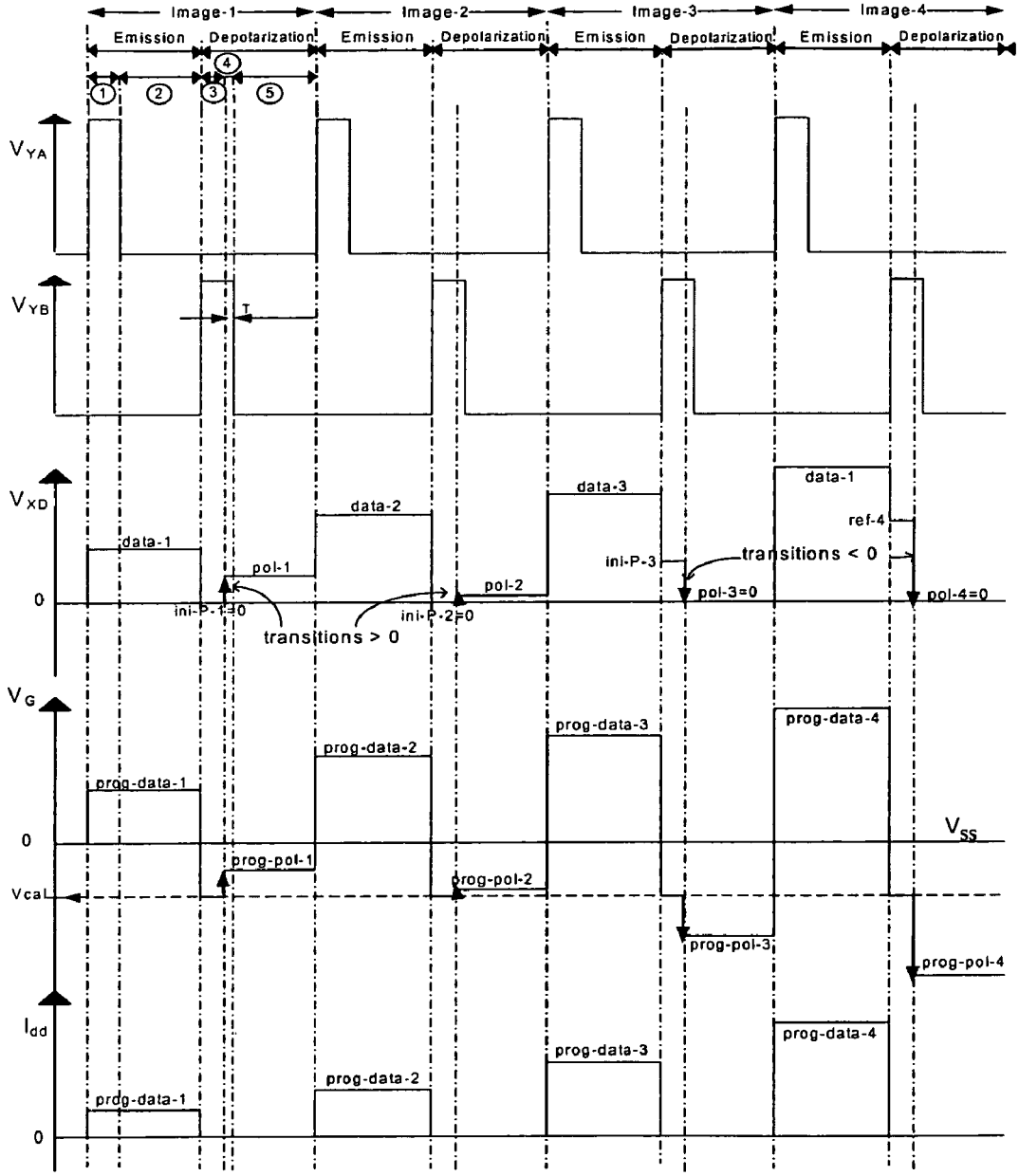

The invention will be better understood from reading the description that follows, given by way of non-limiting example and with reference to the appended figures in which:

FIGS. 1 and 2 described two embodiments of panel drivers according to the invention;

FIG. 3 is a timing diagram of the signals applied during a succession of periods and frames for the control of the circuit of FIG. 2 when controlling the panel of FIG. 2 (logic signals $V_{YA}$, $V_{YB}$, address signals $V_{XD}$); this timing diagram also illustrates the trend of the control potential of the modulator $V_G$ of this circuit, and of the intensity $I_{dd}$ of the current circulating in the diode that is controlled by this circuit.

The figures representing timing diagrams do not take into account a scale of values, the better to show certain details that would not be clearly apparent if the proportions had been respected.

In order to simplify the description, identical references are used for those elements that handle the same functions.

The embodiments described below concern image display panels in which the emitters are organic light-emitting diodes deposited on an active matrix incorporating drivers and power supply circuits for these diodes. These emitters are arranged in rows and columns.

There now follows a description of a first embodiment of the invention. With reference to FIG. 1 which describes a driver and power supply circuit 1" of a diode and its connections to the electrodes of the panel, the active matrix of the panel according to this first embodiment comprises:

an array of address electrodes arranged in columns so that all the circuits controlling the diodes of one and the same column are served by the same address electrode $X_D$;

an array of select electrodes $Y_S$ arranged in rows so that all the circuits controlling the diodes of one and the same row are served by the same electrode;

a reference electrode $P_R$ common to all the circuits;

a base power supply electrode $P_B$ common to all the circuits;

The active matrix also comprises a driver and power supply circuit 1" for each diode 2.

The panel also comprises an upper power supply electrode $P_A$, common to all the diodes.

The driver and power supply circuit 1 of each diode 2 comprises:

- a current modulator T2 comprising two current terminals, namely a drain terminal D and a source terminal S, and a gate terminal G, which in this case corresponds to the control terminal C of the circuit.
- a sustain capacitor $C_S$ connected between said gate G and a clamping terminal R of the circuit.

The control terminal C of the circuit is coupled to an address electrode $X_D$ via a select switch T4 and a coupling capacitor $C_C$, which are connected in series; here, there is no connection by electrical conduction between this control terminal C and this address electrode $X_D$. Preferably, this coupling capacitor $C_C$ is common to all the drivers served by this address electrode. The select switch T4 is controlled by a select electrode $Y_S$.

The circuit 1" also comprises a clamping switch T3 designed to link the control terminal C to the clamping terminal R of the circuit, in this case via the switch T4 or, optionally, directly; this clamping switch T3 is controlled by the same select electrode $Y_S$ as the select switch T4. The clamping terminal R is linked to the reference electrode $P_R$.

The current modulator T2 is linked in series with the diode 2: the drain terminal D is thus connected to the cathode of the diode 2. This series is connected between two power supply electrodes: the source terminal S is connected to the base power supply electrode $P_B$ and the anode of the diode 2 is connected to the upper power supply electrode $P_A$.

There now follows a description of the operation of the panel according to this first embodiment.

The potentials $V_{cal}$, Vdd and Vss are respectively applied to the reference electrode $P_R$ and the power supply electrodes $P_A$ and $P_B$. Here, the potential Vss of the base power supply electrode $P_B$ is zero and is used as a reference for the control voltage of the circuit 1", which here corresponds to the difference $V_G-V_S=V_G-Vss=V_G$. Other references for the control voltage of the circuit can be considered without departing from the spirit of the invention.

For the control of each driver 1" of a diode 2, the duration of each image frame is then broken down into six steps.

Step 1 for clamping the circuit during the emission period: this step marks the start of the emission period of the diode in this image or image frame.

The select switch T4 and the clamping switch T3 are closed simultaneously by applying to the select electrode $Y_S$ an appropriate logic signal; the closure of T4 causes the driver 1" of the diode 2 to be selected by coupling, via the capacitor $C_C$, the control terminal C to the address electrode $X_D$; the simultaneous closure of the switches T3 and T4 results, despite the coupling, in the potential of the control terminal C being clamped to the clamping potential $V_{cal}$ applied to the clamping electrode $P_R$; during this clamping step, the potential of the address electrode is raised to the value $V_{ini\text{-}E}=0$. The duration of this step is long enough to obtain the stabilization of the potentials, and in particular for the potential of the gate G to remain at the value $V_{cal}$.

Step 2 for programming the circuit during the emission period:

The duration of this step is particularly critical to obtain the addressing of the panel as described below.

While sustaining at the start of this step the same logic signal at the select electrode $Y_S$—the effect of which is to keep the clamping switch T3 and the select switch T4 closed—the potential of the address electrode is raised to the value $V_{data\text{-}1}$, which is therefore subject to a potential jump $\Delta V_{data\text{-}1}=V_{data\text{-}1}-V_{ini\text{-}E}=V_{data\text{-}1}$. By transient capacitive coupling via the coupling capacitor $C_C$, the potential of the control terminal C is then subject to a (positive) transient peak based on the value $V_{cal}$ of the clamping potential.

At an instant T evaluated relative to the instant of application of the potential jump $\Delta V_{data\text{-}1}$ to the address electrode $X_D$, the select switch T4 and the clamping switch T3 are opened simultaneously by applying to the select electrode $Y_S$ an appropriate logic signal; the instant T is chosen to be as close as possible to the instant of the top of the transient peak, as described below in greater detail.

The potential $V_G$ of the control terminal C is thus "locked" onto a value $V_{prog\text{-}data\text{-}1}$; the voltage jump $\Delta V_{prog\text{-}data\text{-}1}=V_{prog\text{-}data\text{-}1}-V_{cal}$ is proportional to $\Delta V_{data\text{-}1}$; the value of $V_{data\text{-}1}$ is established such that the control voltage of the modulator $V_G-V_S=V_{prog\text{-}data\text{-}1}-Vss=V_{prog\text{-}data\text{-}1}$ is proportional to the image datum to be displayed by the diode 2 during this image frame.

At this stage, the diode 2 then starts to emit a luminance that is proportional, apart from said correction, to the image datum of the pixel or sub-pixel that is associated with it in this image frame.

It should be noted that the voltage of the control terminal C would return to the value $V_{cal}$ if T were chosen to be too long.

Step 3 for maintaining the circuit during the emission period:

During the rest of the emission period of this diode 2 in this image frame, the select switch T4 and the clamping switch T3 remain open; the driver 1" is therefore no longer selected. During this step, the capacitor $C_S$ maintains at a constant value the voltage of the control terminal C, and the diode 2 therefore continues to emit a luminance proportional to the image datum of the pixel or sub-pixel that is associated with it.

During this step 3, the steps 1 and 2 above are applied to the drivers of the diodes of the other rows so as to display all of the image.

Step 4 for clamping the control of the modulator during the depolarization period:

The start of this step marks the end of the emission period of the diode and the start of the depolarization period of the modulator T2.

The select switch T4 and the clamping switch T3 are simultaneously closed by applying to the select electrode $Y_S$ an appropriate logic signal; the closure of T4 causes the driver 1 of the diode 2 to be selected by coupling, via the capacitor $C_C$, the control terminal C of the modulator T2 to the address electrode $X_D$; the simultaneous closure of the switches T3 and T4 causes, despite the coupling, the potential $V_G$ of the control terminal C to be clamped to the clamping potential $V_{cal}$ applied to the reference electrode $P_R$; while these switches are simultaneously closed, the potential of the address electrode is raised to the value $V_{ini\text{-}P\text{-}1}$, the value of which will be established later. The duration of this step is long enough to obtain the stabilization of the potentials, in particular for the potential of the control terminal C to remain at the value $V_{cal}$.

Step 5 for programming the circuit during the depolarization period:

The duration of this step is also particularly critical for obtaining the addressing of the panel as described below.

While sustaining at the start of this step the same logic signal at the select electrode $Y_S$—the effect of which is to keep the clamping switch T3 and the select switch T4 closed—the potential of the address electrode is raised to the value $V_{pol\text{-}1}$, which is therefore subject to a potential jump $\Delta V_{pol\text{-}1}=V_{pol\text{-}1}-V_{ini\text{-}P}$. By transient capacitive coupling via the coupling capacitor $C_C$, the potential of the control terminal C is then subject to a (positive) transient potential peak based on the value $V_{cal}$ of the clamping potential.

At an instant T evaluated relative to the instant of application of the potential jump $\Delta V_{pol-1}$ to the address electrode $X_D$, the select switch T4 and the clamping switch T3 are simultaneously opened by applying to the select electrode $Y_S$ an appropriate logic signal; the instant T is chosen to be as close as possible to the instant of the top of the potential peak, as described below in greater detail.

Thus, the potential $V_G$ of the control terminal C is locked onto a value $V_{prog-pol-1}$; the potential jump $\Delta V_{prog-pol-1}=V_{prog-pol-1}-V_{cal}$ is proportional to $\Delta V_{pol-1}=V_{pol-1}-V_{ini-P-1}$; according to the invention, the values of $V_{ini-P-1}$ and of $V_{pol-1}$ are chosen according to a double criterion:

criterion 1: the difference $\Delta V_{pol-1}$ is adapted to obtain a (negative) depolarization control voltage of the modulator $V_G-V_S=V_{prog-pol-1}-VSS=V_{prog-pol-1}$ of appropriate value, in a manner known per se, to compensate for the drift of the trigger threshold voltage of the modulator which occurred during the preceding emission period;

criterion 2: $V_{ini-P-1}$ is high enough for $V_{pol-1}$, defined according to the criterion 1, to be positive or zero. Preferably, when the value of $V_{pol-1}$ permits it, $V_{ini-P-1}=0$ is chosen.

Thus, the voltage of the address electrode never changes sign and advantageously conventional and inexpensive means can be used for controlling the address electrodes.

At this stage, the modulator T2 starts to be depolarized in proportion to the value of $V_{prog-pol-1}$.

Step 6 for maintaining the circuit during the depolarization period:

During the rest of the depolarization period of this diode 2 in this image frame, the select switch T4 and the clamping switch T3 are maintained open; the driver 1" is therefore no longer selected. During this step, the capacitor $C_S$ maintains at a constant value the voltage of the control terminal C, and the modulator T2 therefore continues to be depolarized in proportion to the value of $V_{prog-pol-1}$.

During this step 6, the steps 4 and 5 above are applied to the drivers of the other rows of diodes so as to depolarize the modulators of all the drivers of the panel.

The end of this step marks the end of the depolarization period of the modulator T2 and the start of a new emission period of the diode 2, in a new image frame. To obtain the requisite potential jumps $\Delta V_{prog-data-1}$ and $\Delta V_{prog-pol-1}$ on the gate G of the modulator T2, the duration T of the programming steps 2 and 4 is therefore particularly critical.

If $C_C$ and $C_S$ denote, as previously, the values of the capacitances respectively of the coupling capacitors and of the sustain capacitors, if R4 denotes the electrical resistance of the select switch T4 when it is closed, if R3 denotes the electrical resistance of the clamping switch T3 when it is closed, it is demonstrated that the potential peak on the gate G is obtained at an instant $t=T_0$ offset from the instant t=0 when the voltage jump $\Delta V_{data-1}$ and $\Delta V_{pol-1}$ is applied to the address electrode, where $$T_0 = \frac{(R3\times C_C)\cdot(R4\times C_S)}{(R3\times C_C)-(R4\times C_S)}\mathrm{Ln}\left(\frac{R3\times C_C}{R4\times C_S}\right)$$

Since the transistors of the driver are made of amorphous silicon, the values of R4 and R3 are normally high, at around a hundred or so kiloOhms, which induces relatively high time constants $R3\times C_C$ and $R4\times C_S$. By taking R3=R4==1 MΩ, $C_S$=0.5 pF, $C_C$=3 pF, so $T_0$=1 μs.

Preferably, it is best to choose the value of T such that $T_0 \leqq T \leqq 1.1\ T_0$.

It has been indicated above that, in the step 2, the potential jump $\Delta V_{prog-data-1}=V_{prog-data-1}-V_{cal}$ was proportional to $\Delta V_{data-1}==V_{data-1}-V_{ini-E-1}$, and that, in the step 5, the voltage jump $\Delta V_{prog-pol-1}=V_{prog-pol-1}-V_{cal}$ was proportional to $\Delta V_{pol-1}=V_{pol-1}-V_{ini-P-1}$; this proportionality depends not only on the duration T of the programming steps 2 and 5, but also on the "coupling factor" between the address electrode $X_D$ and the control terminal C. It can be demonstrated that the proportionality constant K(t), that is the coupling constant, between the potential jumps on the control terminal C: $\Delta V_{prog-data-1}$, $\Delta V_{prog-pol-1}$, $\Delta V_{prog-data-2}$ and $\Delta V_{prog-pol-2}$, and the corresponding potential jumps on the address electrode $\Delta V_{data-1}$, $\Delta V_{pol-1}$, $\Delta V_{data-2}$ and $\Delta V_{pol-2}$, that changes over time from the instant t=0 at which said potential jump is applied on the address electrode, is expressed in the form:

$$K(t) = K\times(1-e^{-\frac{t}{\tau}}),$$

where $K=C_C/(C_C+C_S)$, $C_C$ and $C_S$ here denoting the values of the capacitances respectively of the coupling capacitors and of the sustain capacitors, where $\tau=R4\times C_S\times C_C/(C_C+C_S)$, where R4 denotes the electrical resistance of the select switch when it is closed.

To obtain the stabilization of the potentials and to charge the sustain capacitor $C_S$ in an addressing step (step 2 or 5 above), it is preferable for the duration of this step to be at least equal to 5×τ.

It may be that the control voltage of the modulator T2 is subject to a slight drop $-\Delta V_{prog-data-cor}$ between the step 2 and the step 3, $-\Delta V_{prog-pol-cor}$ between the step 5 and the step 6, because of the elimination of the capacitive coupling; in order for the depolarization of the modulator to conform to the objectives, it is then preferable to add a correction $+\Delta V_{prog-data-cor}$, $+\Delta V_{prog-pol-cor}$ to the target value $V_{prog-data-1}$, $V_{prog-pol-1}$.

There now follows a description of a second embodiment of the invention which is distinguished from the first embodiment mainly in that, in the emission periods, the addressing of the circuits is performed in a conventional way by conduction between the address electrodes and the control terminal of the circuits; with reference to FIG. 2, the panel then comprises two arrays of select electrodes $Y_{SE}$ and $Y_{SP}$, the first array being used in the emission periods, and the second array in the depolarization periods; each driver 1''' is differentiated from the one 1" of the first embodiment that has just been described in that it also comprises a select switch for the emission T1 suitable for short circuiting the coupling capacitor $C_C$ so as to link the control terminal C by conduction to the address electrode $X_D$; this switch T1 is controlled by a select electrode for the emission $Y_{SE}$; the select switch T4 is used for the depolarization only; the drivers of the emitters therefore each comprise four TFT transistors.

There now follows a description of the operation of the panel according to this second embodiment, with reference to FIG. 3.

For the control of each driver 1''' of a diode 2, the duration of each image frame is then broken down into five steps. The operation is differentiated from the previous description in that:

the steps 1, 2 of the emission period are modified and replaced by the step 1 below;

the step 3 of the emission period and the steps 4, 5 and 6 of the depolarization period are unchanged and respectively renumbered 2, 3, 4 and 5.

The potentials $V_{cal}$, Vdd et Vss are applied respectively to the reference electrode $P_R$ and the power supply electrodes $P_A$ and $P_B$.

Step 1 for addressing the circuit during the emission period: this step marks the start of the emission period of the diode in this image frame; during this period, the select switches for the depolarization T4 and the clamping switch T3 remain open.

The select switch is closed for the emission T1 by applying to the select electrode $Y_S$ an appropriate logic signal; the closure of T1 causes the circuit to be selected for the emission by linking the gate G of the modulator T2 to the address electrode $X_D$; during this step, the potential of the address electrode is raised to the value $V_{data\text{-}1}$ which is passed on to the control gate G of the modulator T2. The duration of this step is long enough to charge the sustain capacitor $C_S$; the diode 2 therefore starts to emit a luminance proportional to the image datum of the pixel or sub-pixel that is associated with it in this image frame.

Step 2 for maintaining the circuit during the emission Period: see preceding step 3.

During the rest of the emission period of this diode 2 in this image frame, the select switches T1 and T4, and the clamping switch T3 remain open; the driver 1''' is therefore no longer selected for the emission or for the depolarization. During this step, the capacitor $C_S$ maintains at a constant value the control voltage of the modulator T2, and the diode 2 therefore continues to emit a luminance proportional to the image datum of the pixel or sub-pixel that is associated with it.

During this step 3, the step 1 above is applied to the drivers of the diodes of the other rows so as to display all of the image.

Step 3 for clamping the control of the modulator during the depolarization period: see preceding step 4.

The start of this step marks the end of the emission period of the diode and the start of the depolarization period of the modulator T2. During the depolarization period, the select switch for the emission therefore remains open.

Step 4 for programming the circuit during the depolarization Period: see preceding step 5.

Step 5 for maintaining the circuit during the depolarization period: see preceding step 6.

The end of this step marks the end of the depolarization period of the modulator T2 and the start of a new emission period of the diode 2, in a new image frame. The embodiments described above relate to organic light-emitting diode display panels with active matrix; the invention applies more generally to all sorts of active matrix display panels, in particular to current-controllable emitters or to optical valves.

The invention claimed is:

1. Display panel comprising:

an array of light emitters, an active matrix comprising an array of electrodes for addressing voltage-mode signals, a first array of select electrodes, at least one reference electrode for addressing, an array of circuits each suitable for controlling each of said emitters and each provided with a voltage-mode control terminal suitable for coupling to an address electrode via a coupling capacitor and via a first select switch which are mounted in series, a voltage-mode clamping terminal suitable for connecting to said control terminal via a clamping switch of the same polarity as the select switch, and a sustain capacitor mounted between said control terminal and said clamping terminal, said sustain capacitor being arranged in parallel to said clamping switch, wherein:

the clamping terminal is linked to the at least one reference electrode, the control of said first select switch and the control of said clamping switch are directly connected to the same select electrode of said first array; the array of light emitters suitable to be powered between at least one base power supply electrode and at least one upper power supply electrode, wherein each of said array of circuits of an emitter comprises a current modulator comprising a voltage-mode control electrode forming the control electrode of said array of circuits and two current-passing electrodes that are connected between one of said power supply electrodes and a power supply electrode of said emitter.

2. Panel according to claim 1, wherein said current modulator is a transistor comprising a semiconductor layer of amorphous silicon.

3. Panel according to claim 1, wherein said emitters are light-emitting diodes.

4. Panel according to claim 1, wherein said array of circuits comprises a second select switch suitable for linking said control terminal to said address electrode without passing through said coupling capacitor.

5. Method of controlling a display panel comprising an array of light emitters, an active matrix comprising an array of electrodes for addressing voltage-mode signals, a first array of select electrodes, at least one reference electrode for addressing, an array of circuits each suitable for controlling each of said emitters and each provided with a voltage-mode control terminal suitable for coupling to an address electrode via a coupling capacitor and via a first select switch which are mounted in series, a voltage-mode clamping terminal suitable for connecting to said control terminal via a clamping switch of the same polarity as the select switch, and a sustain capacitor mounted between said control terminal and said clamping terminal, said sustain capacitor being arranged in parallel to said clamping switch, wherein the clamping terminal is linked to the at least one reference electrode, the control of said first select switch and the control of said clamping switch are directly connected to the same select electrode of said first array, the array of light emitters suitable to be powered between at least one base power supply electrode and at least one upper power supply electrode;

wherein each of said array of circuits of an emitter comprises a current modulator comprising a voltage-mode control electrode forming the control electrode of said array of circuits and two current-passing electrodes that are connected between one of said power supply electrodes and a power supply electrode of said emitter; the method comprises a succession of periods during which a predetermined voltage is applied and sustained at the control terminal of at least one control circuit of said panel, in which, in at least one of said periods, said predetermined voltage is applied to the control terminal of each circuit by transient capacitive coupling according to the following steps:

a clamping step, during which, said reference electrode of the panel being raised to a clamping potential, a select signal is applied to the select electrode that controls the first select switch and the clamping switch of said control circuit, this signal being suitable for closing said switches, and, while said select signal is being applied, an initial voltage signal is applied to the address electrode, a circuit programming step, during which, still while said select signal is being applied, after the clamping of the potential of the control terminal to the clamping potential of the clamping terminal linked to said reference electrode has been obtained, and after the application of said initial signal, a final voltage signal is applied to said address electrode, this final signal generating a voltage jump on this address electrode which in turn generates a transient voltage jump on the control terminal that is coupled to said address electrode, and, during said transient voltage jump, said select signal is ended, the values of said initial signal and of said final signal being adapted to obtain at the moment when said select signal is ended, a voltage jump on said control terminal which makes it possible to obtain said predetermined voltage, wherein the said periods comprises emission periods and depolarization periods, a predetermined depolarization voltage to be applied and to be sustained at the control terminal of a control circuit during a depolarization period are of a polarity opposite to a predetermined emission voltage to be applied and to be sustained at the control terminal of the same circuit during an emission period, this emission voltage being obtained by the application of emission signals to the address electrode to which said control terminal is suitable for coupling.

6. Method according to claim 5, wherein the time interval T between said voltage jump at the address electrode and the end of said select signal is adapted so that the voltage jump obtained at the control terminal is approximately maximum.

7. Method according to claim 5, wherein:

when $C_C$ and $C_S$ denote the values of the capacitances respectively of the coupling capacitors and of the sustain capacitors, when R4 denotes the electrical resistance of the select switch when it is closed, when R3 denotes the electrical resistance of the clamping switch when it is closed, . . . when $T_0$ is defined by the equation:

$$T_0 = \frac{(R3 \times C_C) \cdot (R4 \times C_S)}{(R3 \times C_C) - (R4 \times C_S)} \mathrm{Ln}\left(\frac{R3 \times C_C}{R4 \times C_S}\right),$$

then, the time interval T between said voltage jump at the address electrode and the end of said select signal is such that $T_0 \leqq T \leqq 1.1\ T_0$.

8. Method according to claim 5, wherein the at least one period of application of voltage by transient capacitive coupling comprises said depolarization periods, and wherein, for each of said depolarization periods and for the application by transient capacitive coupling of a predetermined depolarization voltage to the control terminal of each control circuit of said panel, said initial voltage signal and said final voltage signal are chosen such that they present the same polarity as said emission signals.

* * * * *